US011976914B1

(12) United States Patent
Yang et al.

(10) Patent No.: US 11,976,914 B1
(45) Date of Patent: May 7, 2024

(54) EFFICIENT BLASTING METHOD FOR SIMILAR CUTTING IN ROCK TUNNEL

(71) Applicants: UNIVERSITY OF SCIENCE AND TECHNOLOGY BEIJING, Beijing (CN); CHINA UNIVERSITY OF MINING AND TECHNOLOGY, BEIJING, Beijing (CN)

(72) Inventors: Renshu Yang, Beijing (CN); Yanbing Wang, Beijing (CN); Chengxiao Li, Beijing (CN); Zhaoran Zhang, Beijing (CN); Xinmin Ma, Beijing (CN); Hang Zhang, Beijing (CN); Zhouqi Bao, Beijing (CN)

(73) Assignees: University of Science and Technology Beijing, Beijing (CN); China University of Mining and Technology, Beijing, Beijing (CN)

( * ) Notice: Subject to any disclaimer, the term of this patent is extended or adjusted under 35 U.S.C. 154(b) by 0 days.

(21) Appl. No.: 18/370,545

(22) Filed: Sep. 20, 2023

(30) Foreign Application Priority Data

Jan. 17, 2023 (CN) ..... 202310062068.1

(51) Int. Cl.

| | |
|---|---|
| ***F42D 1/22*** | (2006.01) |
| ***E21D 9/00*** | (2006.01) |
| ***F42D 3/04*** | (2006.01) |

(52) U.S. Cl.
CPC ..... *F42D 1/22* (2013.01); *E21D 9/006* (2013.01); *F42D 3/04* (2013.01)

(58) Field of Classification Search
CPC ..... F42D 3/04; F42D 1/22; F42D 1/18; F42D 1/08; E21D 9/006
See application file for complete search history.

(56) References Cited

PUBLICATIONS

CN 108007285 (Year: 2018).*

* cited by examiner

*Primary Examiner* — Sunil Singh
(74) *Attorney, Agent, or Firm* — Notaro, Michalos & Zaccaria P.C.

(57) ABSTRACT

An efficient blasting method for similar cutting in a rock tunnel is provided, which relates to the technical field of rock tunneling. The method includes the following steps: drilling: drilling central holes, lower cutting holes, upper cutting holes, auxiliary holes and peripheral holes in a cross section area for tunnel construction; filling explosives: filling explosives into the central holes, the lower cutting holes, the upper cutting holes, the auxiliary holes and the peripheral holes; and blasting: blasting following blast holes in turn to complete full-face one-time blasting in a millisecond delay blasting mode. The method is applicable for construction scenes of drilling and blasting methods.

12 Claims, 2 Drawing Sheets

EFFICIENT BLASTING METHOD FOR SIMILAR CUTTING IN ROCK TUNNEL

CROSS REFERENCE TO RELATED APPLICATION

This patent application claims the benefit and priority of Chinese Patent Application No. 2023100620681, entitled "EFFICIENT BLASTING METHOD FOR SIMILAR CUTTING IN ROCK TUNNEL" filed on Jan. 17, 2023, the disclosure of which is incorporated by reference herein in its entirety as part of the present disclosure.

TECHNICAL FIELD

The present disclosure relates to the technical field of rock tunneling, in particular to an efficient blasting method for similar cutting in a rock tunnel.

BACKGROUND

The drilling and blasting method is a traditional tunneling method, and is widely used in the tunneling construction of shafts and tunnels, especially in rock tunneling. However, at present, there are some problems in the drilling and blasting method, such as shallow drilling, a large number of blast holes and long construction period. Because of these problems, the efficiency of the traditional drilling and blasting method is very low, and the average drill footage per month is between 60 m and 70 m. However, the demand for coal is increasing year by year in China. Because the rock channel plays an important role in personnel passage, equipment transportation and ventilation and dust reduction, the efficiency of tunneling construction seriously restricts the efficiency of coal mining. Therefore, the improvement on the efficiency of rock tunneling is of great significance for alleviating mining contradictions, improving coal production capacity and shortening the operation cycle of workers.

In the single drilling and blasting construction operation, drilling, filling explosives and connection occupy 60% to 80% of the construction period. At present, manual drilling is widely used in China, and the equipment is a hand-held air hammer. The equipment is simple to operate, but the drill hole is shallow and the drilling efficiency is low. In addition, the mine rock gangway section conforming to the standardized construction of China is usually large, and the number of drill holes is about 120, so that the drilling time is greatly increased, the subsequent filling explosives and connection time is increased, and the operation cycle is prolonged. Although the equipment gradually adopts mechanized methods, for example, the drilling speed can be slightly increased by using an integrated drilling and pile machine, for a large cross-section tunnel, a large number of drill holes is the most basic problem affecting the whole operation cycle.

SUMMARY

For this purpose, the embodiments of the present disclosure provide an efficient blasting method for similar cutting in a rock tunnel. By adjusting the arrangements of cutting holes, the resistance lines of blast holes is optimized, the number of drill holes is reduced, and the cutting efficiency is improved.

In the first aspect, the efficient blasting method for similar cutting in the rock tunnel provided by the embodiments of the present disclosure includes the following steps: drilling: drilling central holes, lower cutting holes, upper cutting holes, auxiliary holes and peripheral holes in a cross section area for tunnel construction; wherein the central holes are formed in a middle of the cross section area, the lower cutting holes are respectively formed in both sides of the central holes, the lower cutting holes are located at a lower part of the cross section area, the upper cutting holes are located at an upper part of the cross section area, the auxiliary holes are located on an outer side of the lower cutting holes and an outer side of the upper cutting holes, and the peripheral holes are arranged along a contour edge of the cross section area; filling explosives: filling the explosives into the central holes, the lower cutting holes, the upper cutting holes, the auxiliary holes and the peripheral holes; wherein each of the central holes is filled with central hole explosives, each of the lower cutting holes is filled with lower first-section explosives and lower second-section explosives, each of the upper cutting holes is filled with upper first-section explosives and upper second-section explosives, the lower first-section explosives are located at a bottom of each of the lower cutting holes, and the upper first-section explosives are located at a bottom of each of the upper cutting holes, each of the auxiliary holes is filled with auxiliary hole explosives, and each of the peripheral holes is filled with peripheral hole explosives; blasting: blasting following blast holes in turn to complete full-face one-time blasting in a millisecond delay blasting mode: first-section blasting: blasting the lower first-section explosives in each of the lower cutting holes; second-section blasting: simultaneously blasting the lower second-section explosives in each of the lower cutting holes and the central hole explosives in each of the central holes; third-section blasting: blasting the upper first-section explosives in each of the upper cutting holes; fourth-section blasting: blasting the upper second-section explosives in each of the upper cutting holes; fifth-section blasting: blasting the auxiliary hole explosives in each of the auxiliary holes; and sixth-section blasting: blasting the peripheral hole explosives in each of the peripheral holes.

In some embodiments, the central holes, the lower cutting holes, the upper cutting holes, the auxiliary holes and the peripheral holes are all perpendicular to a free surface of the rock tunnel.

In some embodiments, an area of the cross section area for tunnel construction is greater than 15 $m^2$.

In some embodiments, the central holes are located on a central axis of the cross section area, and a distance between every two adjacent central holes of the central holes is 0.4-0.6 m; the lower cutting holes are located at a lower straight wall part of the cross section area, and a distance between every two adjacent lower cutting holes of the lower cutting holes is 1.6-1.8 m; the upper cutting holes are located in an upper semi-circular arch part of the cross section area, the upper cutting holes are arranged according to a semi-circular arc shape, and a distance between every two adjacent upper cutting holes of the upper cutting holes is 0.4-0.6 m.

In some embodiments, the auxiliary holes are arranged to adjust a number of the auxiliary holes according to a size of a field cross section.

In some embodiments, a depth of each of the central holes, the lower cutting holes, the upper cutting holes, the auxiliary holes and the peripheral holes is greater than 2 m, and a diameter of each of the central holes, the lower cutting holes, the upper cutting holes, the auxiliary holes and the peripheral holes is greater than 40 mm.

In some embodiments, a mass of the central hole explosives in each of the central holes is 0.5-0.75 times of a mass of the lower first-section explosives and the lower second-section explosives in each of the lower cutting holes or a mass of the upper first-section explosives and the upper second-section explosives in each of the upper cutting holes.

In some embodiments, drilling arrangements of the lower cutting holes, the upper cutting holes and the central holes are as follows: drilling the lower cutting holes in a lower straight wall area of the cross section area, wherein an area surrounded by the lower cutting holes is in a rectangular shape; drilling the upper cutting holes in an upper semi-circular arch area of the cross section area, wherein an area surrounded by the upper cutting holes is in a semi-circular arc shape; drilling the central holes in a middle of an area surrounded by the lower cutting holes and the upper cutting holes; and enabling a shape of the area surrounded by the lower cutting holes and the upper cutting holes to be similar to a shape of the cross section area.

In some embodiments, filling explosive arrangements of the lower cutting holes are as follows: inserting a second-section detonator into first explosives to form second explosives, and placing the second explosives into the bottom of each of the lower cutting holes and charging the second explosives to form the lower first-section explosives; plugging the lower first-section explosives with a first tamping plug, wherein a plugging length of the first tamping plug is not less than 0.55 m; placing a first-section detonator into third explosives to form fourth explosives, and placing the fourth explosives into the each of the lower cutting holes and charging the fourth explosives to form the lower second-section explosives; and plugging the lower second-section explosives with a second tamping plug, and plugging the second tamping plug with a first tamping bar.

In some embodiments, filling explosive arrangements of the upper cutting holes are as follows: inserting a third-section detonator into fifth explosives to form sixth explosives, and placing the sixth explosives into the bottom of each of the upper cutting holes and charging the sixth explosives to form the upper first-section explosives; plugging the upper first-section explosives with a third tamping plug, wherein a plugging length of the third tamping plug is not less than 0.55 m; placing a fourth-section detonator into seventh explosives to form eighth explosives, and placing the eighth explosives into each of the upper cutting holes and charging the eighth explosives to form the upper second-section explosives; and plugging the upper second-section explosives with a fourth tamping plug, and plugging the fourth tamping plug with a second tamping bar.

In some embodiments, a length ratio of the lower first-section explosives to the lower second-section explosives is 1.2 to 1.5; and a length ratio of the upper first-section explosives to the upper second-section explosives is 1.2 to 1.5.

In some embodiments, a coal mine allowable digital electronic detonator is used for blasting in the millisecond delay blasting mode, and detonator delay setting is carried out according to specific needs.

According to the efficient blasting method for similar cutting in a rock tunnel provided by the embodiments of the present disclosure, a similar cutting hole arrangement method, a sectional charging method and a coal mine allowable digital electronic detonator delay method are used, so that the range of the slot area is increased, the volume of the slot cavity generated by cutting hole blasting is increased, the minimum resistance lines of the auxiliary holes are reduced and become uniform, the number of the auxiliary holes and the number of the peripheral holes are reduced, and the drilling time and explosive consumption are reduced. At the same time, multi-section delay blasting is used, so that the vibration generated by the blasting can be reduced, and the stability of the tunnel can be improved.

BRIEF DESCRIPTION OF THE DRAWINGS

To describe the technical solutions in the embodiments of the present disclosure or in the prior art more clearly, the following briefly describes the attached figures required for describing the embodiments or the prior art. Apparently, the attached figures in the following description show merely some embodiments of the present disclosure, and those skilled in the art may derive other drawings from these attached figures without creative efforts.

Figure 1:
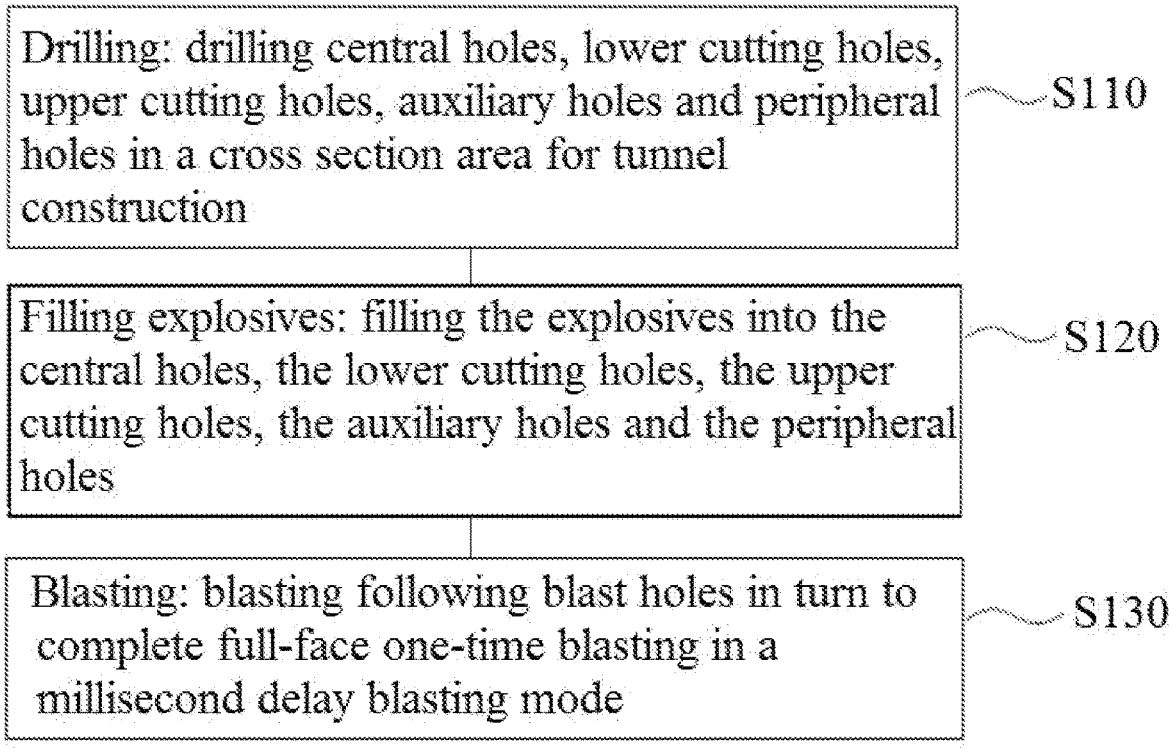
FIG. 1 is a schematic diagram of an efficient blasting method for similar cutting in a rock tunnel according to an embodiment of the present disclosure.

List of the reference characters: 1 central hole; 101 central hole explosive; 2 lower cutting hole; 21 lower first-section explosive; 22 lower second-section explosive; 3 upper cutting hole; 31 upper first-section explosive; 32 upper second-section explosive; 4 auxiliary hole; 41 auxiliary hole explosive; 5 peripheral hole; 51 peripheral hole explosive; 6 tamping plug; 7 tamping plug; 8 tamping plug; 9 tamping plug; 10 rock tunnel free surface; and 11 slot area slot cavity.

DETAILED DESCRIPTION OF THE EMBODIMENTS

The detailed description of the embodiment of the present disclosure is further described in conjunction with the following attached figures.

Apparently, the embodiments in the following description are merely a part rather than all of the embodiments of the present disclosure. All other embodiments obtained by those skilled in the art based on the embodiments of the present disclosure without creative efforts shall fall within the protection scope of the present disclosure.

Embodiment I

The embodiments of the present disclosure provide an efficient blasting method for similar cutting in a rock tunnel. FIG. 1 is a schematic diagram of the efficient blasting method for similar cutting in the rock tunnel according to the embodiments of the present disclosure. The similar cutting refers to that a slot cavity after cutting is similar to a cross section structure of a rock tunnel to be tunneled. Referring to FIG. 1, the efficient blasting method for similar cutting in the rock tunnel mainly includes the following steps.

Figure 2:
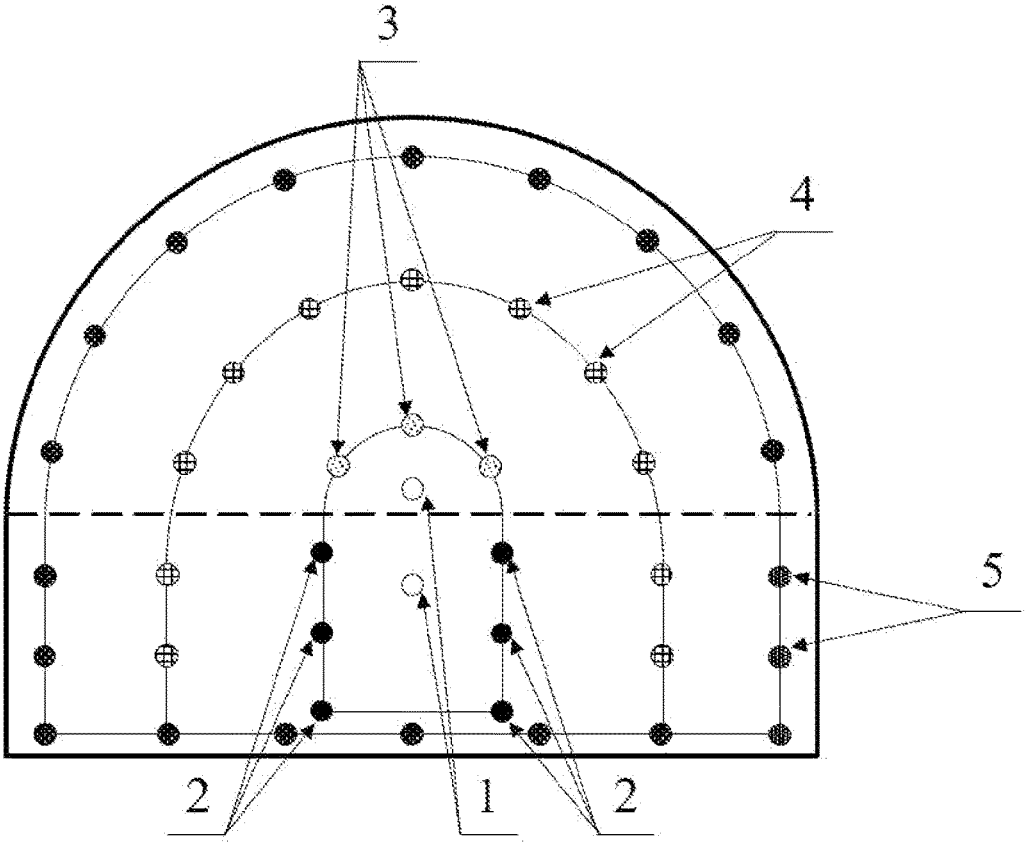
FIG. 2 is an arrangement diagram of blast holes in a cross section area for rock tunnel construction according to the embodiment of the present disclosure.

In S110, drilling: central holes 1, lower cutting holes 2, upper cutting holes 3, auxiliary holes 4 and peripheral holes 5 are drilled in a cross section area for tunnel construction. the central holes 1 are formed in a middle of the cross section area. The central holes 1 are arranged in a middle of a rock tunnel free surface 10. The central holes can play a role in crushing rock, so that the lumpiness of the rock after blasting is reduced, and the time taken to break gangue in subsequent operation is reduced. The lower cutting holes 2 are respectively formed in both sides of the central holes 1. The lower cutting holes 2 are located at a lower part of the cross section area. The upper cutting holes 3 are located at an upper part of the cross section area. The auxiliary holes 4 are located on an outer side of the lower cutting holes 2 and an outer side of the upper cutting holes 3. The peripheral holes 5 are arranged along a contour edge of the cross section area. An arrangement diagram of blast holes in the cross section area for rock tunnel construction is as shown in FIG. 2;

In S120, filling explosives: explosives are filled into the central holes 1, the lower cutting holes 2, the upper cutting holes 3, the auxiliary holes 4 and the peripheral holes 5. The central hole 1 is filled with central hole explosives 101. The lower cutting hole 2 is filled with lower first-section explosives and lower second-section explosives, the upper cutting hole 3 is filled with upper first-section explosives and upper second-section explosives. The lower first-section explosives are located at a bottom of the lower cutting hole 2, and the upper first-section explosives are located at a bottom of the upper cutting hole 3. The auxiliary hole 4 is filled with auxiliary hole explosives 41. The peripheral hole 5 is filled with peripheral hole explosives 51. A schematic diagram of each of the blast holes filled with explosives is as shown in FIG. 3.

Figure 3:
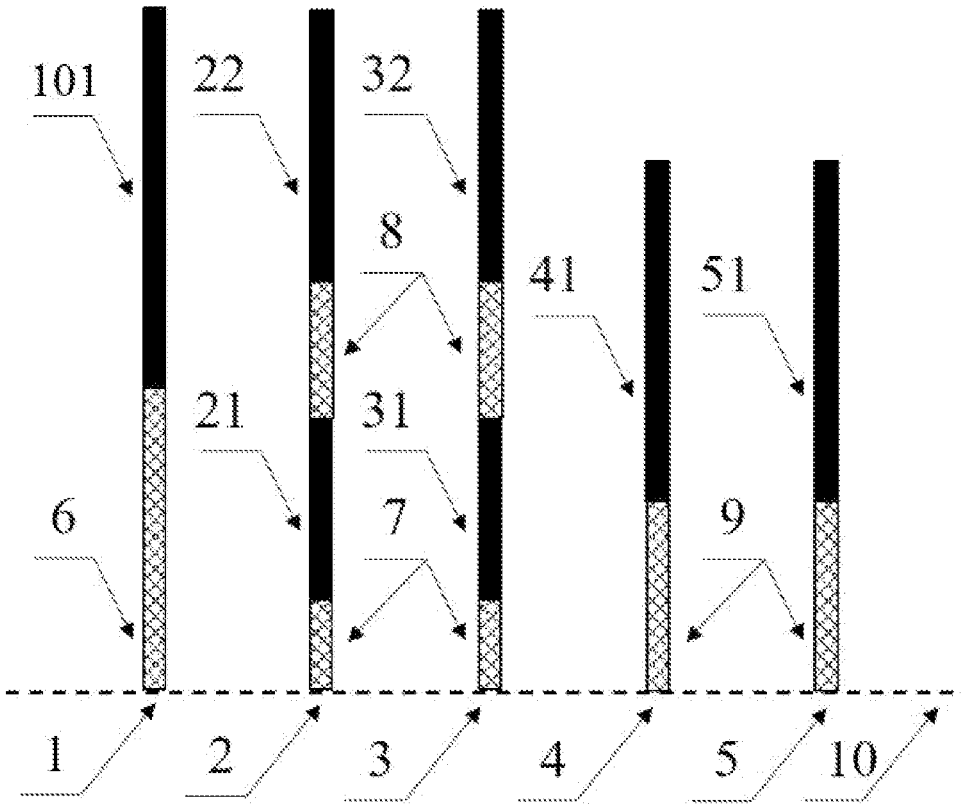
FIG. 3 is a schematic diagram of each of the blast holes in FIG. 2 filled with explosives.

In S130, blasting: following blast holes are blasted in turn to complete full-face one-time blasting in a millisecond delay blasting mode according to the schematic diagram of each of the blast hole filled with the explosives as shown in FIG. 3.

First-section blasting: the lower first-section explosives 21 in the lower cutting hole 2 are blasted.

Second-section blasting: the lower second-section explosives 22 in the lower cutting hole 2 and the central hole explosives 101 in the central hole 1 are simultaneously blasted.

Third-section blasting: the upper first-section explosives 31 in the upper cutting hole 3 are blasted.

Four-section blasting: the upper two-section explosives 32 in the upper cutting hole 3 are blasted.

Five-section blasting: the auxiliary hole explosives 41 in the auxiliary hole 4 is blasted.

Sixth-section blasting: the peripheral hole explosives 51 in the peripheral hole 5 are blasted.

Wherein, the "section" refers to the section of the explosives, which is divided by sections of a millisecond detonator used for blasting, and the explosives in the same section have multiple filling explosive holes and are blasted at the same time. The time difference of blasting with the explosives in adjacent sections is several milliseconds.

In some embodiments, as shown in FIG. 2 and FIG. 3, the central hole 1, the lower cutting hole 2, the upper cutting hole 3, the auxiliary hole 4, and the peripheral hole 5 are all perpendicular to the rock tunnel free surface 10. Through a vertical hole arrangement, the depths of blast holes can be increased without the limitation of cross section size, thus increasing the tunneling depth of single blasting. In addition, through the vertical hole arrangement, the throwing distance of blasting flying stones can be effectively reduced, thus protecting the safety of field instruments and personnel.

In some embodiments, an area of the cross section area for tunnel construction is greater than 15 $m^2$. The area of the cross section area given here has a value that can obviously exert the effect of the blasting technology, and with the increase of the area of the cross section area, the effect becomes more and more obvious, and the technology can also be used when the area of the cross section are is below this value.

In some embodiments, the central holes 1 are located on a central axis of the cross section area, and a distance between every two adjacent central holes 1 is 0.4-0.6 m. The lower cutting holes 2 are located at a lower straight wall part of the cross section area, and a distance between every two adjacent lower cutting holes 2 is 1.6-1.8 m. The upper cutting holes 3 are located in an upper semi-circular arch part of the cross section area, the upper cutting holes 3 are arranged according to a semi-circular arc shape, and a distance between every two adjacent upper cutting holes 3 is 0.4-0.6 m. The above distance parameters of the blast holes can achieve better blasting effect, and can be adjusted according to the site conditions during specific construction.

Further, on the rock tunnel free surface 10, in the cross section area for rock tunnel construction, the lower cutting holes 2 are located at the lower straight wall part of the cross section, and the upper cutting holes 3 are located at the upper semi-circular arch part of the cross section. The cutting holes are arranged at the upper and lower parts of the cross section, so that an area of a cutting area can be increased, the number of the auxiliary holes is reduced.

In some embodiments, the auxiliary holes 4 are arranged to adjust a number of the auxiliary holes according to a size of a field cross section. When the area of the cross section is large, multiple circles of auxiliary holes, usually one to three circles of auxiliary holes, are formed between the peripheral holes and the cutting area according to the actual needs, so that the rock crushing effect is increased.

In some embodiments, the depths of the central hole 1, the lower cutting hole 2, the upper cutting hole 3, the auxiliary hole 4 and the peripheral hole 5 are all greater than 2 m, and the diameters of the central hole 1, the lower cutting hole 2, the upper cutting hole 3, the auxiliary hole 4 and the peripheral hole 5 are all greater than 40 mm. Blast hole depth, blast hole diameter, explosive quantity and other parameters all affect the blasting effect. The embodiments of the present disclosure provide the minimum value of relevant parameters which can be used for better blasting effect, and the values can be adjusted according to the situation during actual operation.

In some embodiments, as shown in FIG. 3, the depth of the central hole 1, the depth of the lower cutting hole 2 and the depth of the upper cutting hole 3 are consistent, the depth of the auxiliary hole 4 and the depth of the peripheral hole 5 are consistent, and the depths of the central hole 1, the lower cutting hole 2 and the upper cutting hole 3 are 300-400 mm greater than those of the auxiliary hole and the peripheral hole. In this way, the crushing degree of rock at the bottom of each of the central hole 1, the lower cutting hole 2 and the upper cutting hole 3 can be increased after the central hole 1, the lower cutting hole 2 and the upper cutting hole 3 are blasted, and the volume of the cutting area can be increased, thus providing sufficient free surface for subsequent blasting of the auxiliary hole 4 and the peripheral hole 5.

In some embodiments, the mass of the explosives in the central hole is 0.5-0.75 times of the mass of the explosives in the lower cutting hole or the upper cutting hole. The central hole is filled with a small quantity of explosives, so that the crushing degree of rock can be improved, and the consumption of the explosives is reduced.

In some embodiments, in the drilling step, as shown in FIG. 2, the drilling arrangements of the lower cutting holes 2, the upper cutting holes 3 and the central holes 1 are as follows. The lower cutting holes 2 are drilled in a lower straight wall area of the cross section area, and an area surrounded by the lower cutting holes 2 is in a rectangular shape. The upper cutting holes 3 are drilled in an upper semi-circular arch area of the cross section area, and an area surrounded by the upper cutting holes 3 is in a semi-circular arc shape. The central holes 1 are drilled in a middle of the area surrounded by the lower cutting holes 2 and the upper cutting holes 3. A shape of the area surrounded by the lower cutting holes 2 and the upper cutting holes 3 is basically similar to a shape of the cross section area.

Figure 4:
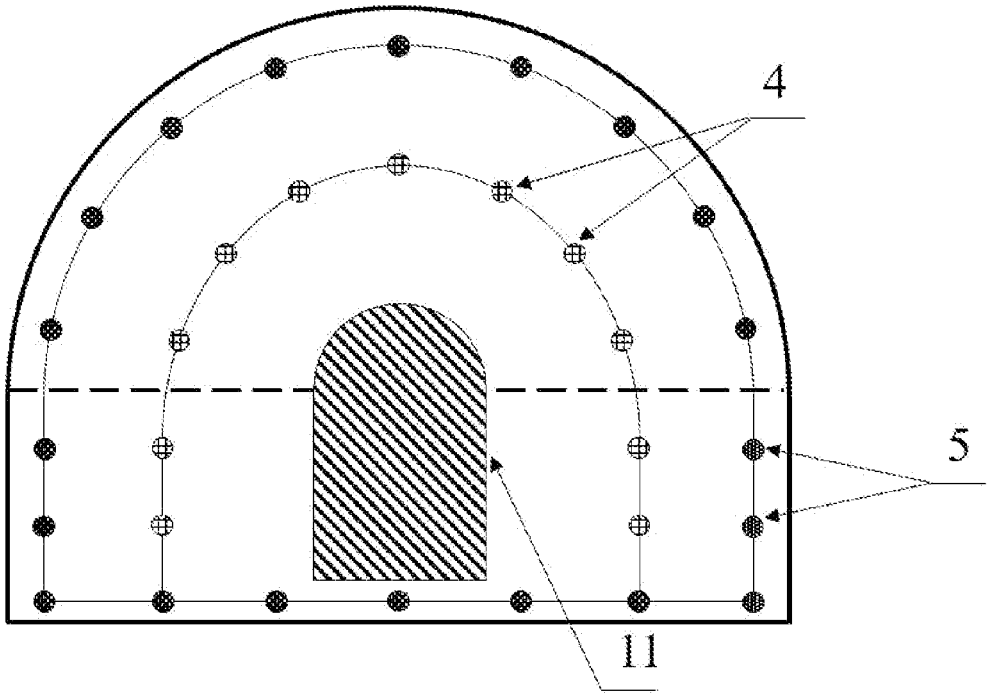
FIG. 4 is a schematic diagram of a slot cavity after cutting holes and central holes in FIG. 2 are blasted.

Further, as shown in FIG. 2, the arrangement of the cutting holes is used in the embodiments of the present disclosure. After the blast holes in the cutting hole area are blasted, the slot area slot cavity 11 as shown in FIG. 4 may be formed. At this time, the minimum resistance lines of all the auxiliary holes 4 are basically uniform, so that the blasting difficulty of the auxiliary holes 4 is reduced, the blasting efficiency of the blast holes is increased, and the blasting efficiency of the peripheral holes 5 is increased.

In some embodiments, in filling explosive step, as shown in FIG. 3, filling explosive arrangement of the lower cutting hole 2 is as follows.

A second-section detonator is inserted into first explosives to form second explosives, and the second explosives are placed into the bottom of the lower cutting hole 2 and are further charged to form the lower first-section explosives 21.

The lower first-section explosives are plugged with a first tamping plug, and a plugging length of the first tamping plug is not less than 0.55 m. The minimum value of the tamping plug 8 is specified here. In order to prevent the sympathetic blasting when the lower first-section explosives are blasted to affect the influence on the lower second-section explosives, it is necessary not only to meet the length, but also to plug the tamping plug with a wooden tamping bar.

A first-section detonator is placed into third explosives to form fourth explosives, and the fourth explosives are placed into the lower cutting hole 2, and are further charged to form the lower second-section explosives 22.

The lower second-section explosives are plugged with a second tamping plug, and the second tamping plug is plugged with a first tamping bar.

Further, in the filling explosive step, as shown in FIG. 3, the filling explosive arrangement of the lower cutting hole 3 is as follows.

A third-section detonator is inserted into fifth explosives to form sixth explosives, and the sixth explosives are placed into the bottom of the upper cutting hole 3 and is further charged to form the upper first-section explosives 31.

The upper first-section explosives are plugged with a third tamping plug, and a plugging length of the third tamping plug is not less than 0.55 m.

A fourth-section detonator is placed into seventh explosives to form eighth explosives, and the eighth explosives are placed into the upper cutting hole 3 and are further charged to form the upper second-section explosives 32.

The upper second-section explosives are plugged with a fourth tamping plug, and the fourth tamping plug is plugged with a second tamping bar.

In some embodiments, a length ratio of the lower first-section explosives 21 to the lower second-section explosives 22 is 1.2 to 1.5. A length ratio of the upper first-section explosives 31 to the upper second-section explosives 32 is 1.2 to 1.5. A length of the lower second-section explosives 22 is greater than a length of the lower first-section explosives 21, and a length of the upper second-section explosives 32 is greater than a length of the upper first-section explosives 31. The bottom of the blast hole suffers from great clamping effect on the rock, so more explosives at the bottom of the blast hole can increase the volume of the slot cavity, and the utilization rate of the explosives is increased.

In some embodiments, in the blasting step, a coal mine allowable digital electronic detonator is used for blasting in the millisecond delay blasting mode, and detonator delay setting is carried out according to specific needs. The application of the coal mine allowable digital electronic detonator can break through the limitation of five-section blasting with a traditional electronic detonator, thus increasing more delay time to meet the blasting sequence of different blast holes.

Further, during blasting, following blast holes are blasted in turn to complete full-face one-time blasting.

First-section blasting: the lower first-section explosives 21 in the lower cutting holes 2 are blasted.

Second-section blasting: the lower second-section explosives 22 in the lower cutting hole 2 and the central hole explosives 101 in the central hole 1 are simultaneously blasted.

Third-section blasting: the upper first-section explosives 31 in the upper cutting hole 3 are blasted.

Four-section blasting: the upper two-section explosives 32 in the upper cutting hole 3 are blasted.

Five-section blasting: the auxiliary hole explosives 41 in the auxiliary hole 4 are blasted.

Sixth-section blasting: the peripheral hole explosives 51 in the peripheral hole 5 are blasted.

Specifically, as shown in FIG. 2, firstly, the lower cutting hole 2 and the central hole 1 are blasted, so that a lower slot cavity may be formed in a small range, and then the upper cutting hole 3 is blasted. Because of the existence of the lower slot cavity, the upper cutting hole is easy to blast, and finally a slot area slot cavity 11 similar to the cross section of the tunnel as shown in FIG. 4 is formed, thus reducing the minimum resistance lines of the auxiliary holes 4 and making it uniform, and finally blasting the peripheral holes 5. In this way, the blasting directions from bottom to top and from inside to outside are formed. The blasting resistance is reduced by multi-section blasting, the volume of the slot area is increased, and the blasting difficulty of other blast holes is reduced. The multi-section blasting is realized by digital electronic detonators, so that the blasting cost is reduced while the blasting vibration is reduced.

Embodiment II

In order to better understand the efficient blasting method for similar cutting in the rock tunnel provided by the present disclosure, the embodiment II provides a concrete case of using the efficient blasting method for similar cutting in the rock tunnel in the present disclosure.

The cross section area of the rock tunnel in a certain coal mine is 21.3 $m^2$. The original blasting tunneling scheme of the coal mine is a single wedge-shaped cut blasting method, the coal mine allowable millisecond delay electronic detonator is used, and usually the blasting is carried out in five sections. The depth of the cutting hole is 2.0 m, and the depths of other holes are 1.8 m. The number of actual construction holes is about 120, and the single tunneling depth is about 1.5 m.

According to the efficient blasting method for similar cutting in the rock tunnel provided by the present disclosure, as shown in FIG. 4, the depths of the cutting hole and the central hole are 2.9 m, and the depths of other holes are 2.5 m. The coal mine allowable digital electronic detonator is used for delayed blasting. Table 1 is a parameter table of the blast holes in the field application example. As shown in Table 1, the delay time may be set arbitrarily in the range of 0-130 ms according to actual needs, the delay error is less than 1 ms, and the number of drill holes is 74 and is 38.3% less than that in the original scheme. During construction, the drilling time, the filling explosive time and the connection time are reduced by about 50%, and the single tunneling depth is 2.3 m. After the new similar cutting blasting technology is used, the number of the drill holes is reduced, the construction period is greatly shortened, the tunneling efficiency is greatly improved, the cost is saved, and the production efficiency is improved.

TABLE 1

| Drill hole names | Serial numbers of drill holes | Numbers of drill holes | Hole depths (mm) | Horizontal angles (°) | Vertical angles (°) | Number of volumes of explosives (volumes) | Delay time (ms) |
|---|---|---|---|---|---|---|---|
| Lower cutting hole $Z_1$ section | 1-6 | 6 | 2900 | 90 | 90 | 4 | 0 |
| Lower cutting hole $Z_2$ section | | | | | | | 25 |
| Central holes | 7~10 | 4 | 2900 | 90 | 90 | 2 | 25 |
| Upper cutting hole $Z_1$ section | 11-14 | 4 | 2900 | 90 | 90 | 4 | 40 |
| Upper cutting hole $Z_2$ section | | | | | | | 65 |
| Auxiliary holes I | 15-28 | 14 | 2500 | 90 | 90 | 2.5 | 80 |
| Auxiliary holes II | 29- 45 | 17 | 2500 | 90 | 90 | 2.5 | 95 |
| Peripheral holes | 46-64 | 19 | 2500 | 90 | 88 | 2.5 | 110 |
| Bottom holes | 65-74 | 10 | 2500 | 90 | 88 | 2.5 | 110 |
| Total | | 74 | | | | 198 | 110 |

In conclusion, according to the efficient blasting method for similar cutting in the rock tunnel provided by the embodiment of the present disclosure, a similar cutting hole arrangement method, a sectional charging method and a coal mine allowable digital electronic detonator delay method are used, so that the range of the cutting area is increased, the volume of the slot cavity generated by cutting hole blasting is increased, the minimum resistance lines of the auxiliary holes are reduced and become uniform, the numbers of the auxiliary holes and the peripheral holes are reduced, and the drilling time and explosive consumption are reduced. At the same time, multi-section delay blasting is used, so that the vibration generated by the blasting can be reduced, and the stability of the tunnel is improved.

Moreover, the terms "include/contain", "composed of . . . ", or their any other variants are intended to cover a non-exclusive inclusion, so that equipment including a series of elements not only includes those elements but also includes other elements that are not expressly listed, or further includes elements inherent to the equipment. An element preceded by "includes/contains . . . ", "composed of . . . " does not, without more constraints, preclude the presence of additional identical elements in the equipment that includes the element.

In this application, except as otherwise noted, the terms such as "install", "link", "connect" and "fix" should be generally understood, for example, the components can be fixedly connected, and also can be detachably connected or integrally connected; the components can be mechanically connected, and also can be electrically connected; the components can be directly connected and also can be indirectly connected through an intermediate, and two components can be communicated internally or interact with each other. For those skilled in the art, the specific meanings of the terms in the present disclosure can be understood according to specific conditions.

In the description of the present disclosure, it needs to be illustrated that the indicative direction or position relations of the terms such as "upper", "lower", "front", "rear", "left", "right", "top", "bottom", "inner" and "outer" are direction or position relations illustrated based on the attached figures, just for facilitating the description of the present disclosure and simplifying the description, but not for indicating or hinting that the indicated device or element must be in a specific direction and is constructed and operated in the specific direction, the terms cannot be understood as the restriction of the present disclosure.

In addition, the terms "first" and "second" are merely intended for a purpose of description, and shall not be understood as an indication or implication of relative importance or implicit indication of the number of indicated technical features. Therefore, a feature limited by "first" or "second" may explicitly or implicitly include one or more features. In the description of the present disclosure, the meaning of "a plurality of" means two or more unless expressly specifically defined otherwise.

The foregoing descriptions are merely specific implementations of the present disclosure, but are not intended to limit the protection scope of the present disclosure. Any variation or replacement readily figured out by those skilled in the art within the technical scope disclosed in the present disclosure shall fall within the protection scope of the present disclosure. Therefore, the protection scope of the present disclosure shall be subject to the protection scope of the claims.

What is claimed is:

1. A blasting method for similar cutting in a rock tunnel, comprising following steps:

drilling central holes, lower cutting holes, upper cutting holes, auxiliary holes and peripheral holes in a cross section area for tunnel construction, and enabling a shape of an area surrounded by the lower cutting holes and the upper cutting holes to be similar to a shape of the cross section area; wherein the central holes are formed in a middle of the cross section area, the lower cutting holes are respectively formed in both sides of the central holes, the lower cutting holes are located at a lower part of the cross section area, the upper cutting holes are located at an upper part of the cross section area, the auxiliary holes are located on an outer side of the lower cutting holes and an outer side of the upper cutting holes, and the peripheral holes are arranged along a contour edge of the cross section area;

wherein drilling arrangements of the lower cutting holes, the upper cutting holes and the central holes are as follows:

drilling the lower cutting holes in a lower straight wall area of the cross section area, wherein an area surrounded by the lower cutting holes is in a rectangular shape, drilling the upper cutting holes in an upper semi-circular arch area of the cross section area, wherein an area surrounded by the upper cutting holes is in a semi-circular arc shape, and drilling the central holes in a middle of an area surrounded by the lower cutting holes and the upper cutting holes:

filling the explosives into the central holes, the lower cutting holes, the upper cutting holes, the auxiliary holes and the peripheral holes; wherein each of the central holes is filled with central hole explosives, each of the lower cutting holes is filled with lower first-section explosives and lower second-section explosives, each of the upper cutting holes is filled with upper first-section explosives and upper second-section explosives, the lower first-section explosives are located at a bottom of each of the lower cutting holes, and the upper first-section explosives are located at a bottom of each of the upper cutting holes, each of the auxiliary holes is filled with auxiliary hole explosives, and each of the peripheral holes is filled with peripheral hole explosives; and blasting following blast holes in turn to complete full-face one-time blasting in a millisecond delay blasting mode:

detonating the lower first-section explosives in each of the lower cutting holes;

simultaneously detonating the lower second-section explosives in each of the lower cutting holes and the central hole explosives in each of the central holes;

detonating the upper first-section explosives in each of the upper cutting holes;

detonating the upper second-section explosives in each of the upper cutting holes;

detonating the auxiliary hole explosives in each of the auxiliary holes; and detonating the peripheral hole explosives in each of the peripheral holes.

2. The blasting method according to claim 1, wherein the central holes, the lower cutting holes, the upper cutting holes, the auxiliary holes and the peripheral holes are all perpendicular to a free surface of the rock tunnel.

3. The blasting method according to claim 1, wherein an area of the cross section area for tunnel construction is greater than 15 $m^2$.

4. The blasting method according to claim 1, wherein a distance between every two adjacent central holes of the central holes is 0.4-0.6 m; a distance between every two adjacent lower cutting holes of the lower cutting holes is 1.6-1.8 m; and a distance between every two adjacent upper cutting holes of the upper cutting holes is 0.4-0.6 m.

5. The blasting method according to claim 1, wherein the auxiliary holes are arranged to adjust a number of the auxiliary holes according to a size of a field cross section.

6. The blasting method according to claim 1, wherein a depth of each of the central holes, the lower cutting holes, the upper cutting holes, the auxiliary holes and the peripheral holes is greater than 2 m, and a diameter of each of the central holes, the lower cutting holes, the upper cutting holes, the auxiliary holes and the peripheral holes is greater than 40 mm.

7. The blasting method according to claim 1, wherein a depth of each of the central holes, a depth of each of the lower cutting holes and a depth of each of the upper cutting holes are consistent, a depth of each of the auxiliary holes and a depth of each of the peripheral holes are consistent, and a depth of each of the central holes, the lower cutting holes and the upper cutting holes is 300-400 mm greater than a depth of each of the auxiliary holes and the peripheral holes.

8. The blasting method according to claim 1, wherein a mass of the central hole explosives in each of the central holes is 0.5-0.75 times of a mass of the lower first-section explosives and the lower second-section explosives in each of the lower cutting holes or a mass of the upper first-section explosives and the upper second-section explosives in each of the upper cutting holes.

9. The blasting method according to claim 1, wherein filling explosive arrangements of the lower cutting holes are as follows:

inserting a second-section detonator into first explosives to form second explosives, and placing the second explosives into the bottom of each of the lower cutting holes and charging the second explosives to form the lower first-section explosives;

plugging the lower first-section explosives with a first tamping plug, wherein a plugging length of the first tamping plug is not less than 0.55 m;

placing a first-section detonator into third explosives to form fourth explosives, and placing the fourth explosives into the each of the lower cutting holes and charging the fourth explosives to form the lower second-section explosives; and plugging the lower second-section explosives with a second tamping plug, and plugging the second tamping plug with a first tamping bar.

10. The blasting method according to claim 1, wherein filling explosive arrangements of the upper cutting holes are as follows:

inserting a third-section detonator into fifth explosives to form sixth explosives, and placing the sixth explosives into the bottom of each of the upper cutting holes and charging the sixth explosives to form the upper first-section explosives;

plugging the upper first-section explosives with a third tamping plug, wherein a plugging length of the third tamping plug is not less than 0.55 m;

placing a fourth-section detonator into seventh explosives to form eighth explosives, and placing the eighth explosives into each of the upper cutting holes and charging the eighth explosives to form the upper second-section explosives; and plugging the upper second-section explosives with a fourth tamping plug, and plugging the fourth tamping plug with a second tamping bar.

11. The blasting method according to claim 1, wherein a length ratio of the lower first-section explosives to the lower second-section explosives is 1.2 to 1.5; and a length ratio of the upper first-section explosives to the upper second-section explosives is 1.2 to 1.5.

12. The blasting method according to claim 1, wherein a coal mine allowable digital electronic detonator is used for blasting in the millisecond delay blasting mode, and detonator delay setting is carried out according to specific needs.

* * * * *